United States Patent [19]

Aoyagi

[11] Patent Number: 5,002,515

[45] Date of Patent: Mar. 26, 1991

[54] RUNNING TOY MOVABLE IN A DIRECTION OTHER THAN THE ORIENTATION OF ITS BODY

[75] Inventor: Hideyuki Aoyagi, Tochigi, Japan

[73] Assignee: Shisei Kogyo Co., Ltd, Tokyo, Japan

[21] Appl. No.: 434,589

[22] Filed: Nov. 13, 1989

Related U.S. Application Data

[63] Continuation of Ser. No. 127,527, Dec. 1, 1987, abandoned, which is a continuation of Ser. No. 845,933, Mar. 28, 1986, abandoned.

[30] Foreign Application Priority Data

Oct. 8, 1985 [JP] Japan ..... 60-154039[U]

[51] Int. Cl.[5] ..... A63H 17/00

[52] U.S. Cl. ..... 446/457; 446/437; 446/470

[58] Field of Search ..... 446/437, 457, 465, 470, 446/464, 462, 431, 269, 289–292, 459, 461, 463, 443, 279, 456

[56] References Cited

U.S. PATENT DOCUMENTS

| | | | |
|---|---|---|---|
| 4,209,941 | 7/1980 | Bourque | 446/462 X |
| 4,380,135 | 4/1983 | Wildman et al. | 446/433 |

FOREIGN PATENT DOCUMENTS

| | | | |
|---|---|---|---|
| 555542 | 7/1923 | France | 446/378 |
| 1320130 | 12/1963 | France | 446/437 |
| 841177 | 7/1960 | United Kingdom | 446/279 |

*Primary Examiner*—Mickey Yu

*Attorney, Agent, or Firm*—Kenyon & Kenyon

[57] ABSTRACT

A running toy movable straight in a direction other than the orientation of its body is disclosed, which includes a body and a chassis mounted thereto and in which the chassis contains a driving mechanism and is turnable in a horizontal plane in relation to the body.

3 Claims, 5 Drawing Sheets

RUNNING TOY MOVABLE IN A DIRECTION OTHER THAN THE ORIENTATION OF ITS BODY

This application is a continuation of Ser. No. 07/127,527, filed on Dec. 1, 1987, now abandoned, which is a continuation of Ser. No. 06/845,933, filed on Mar. 28, 1986, and now abandoned.

FIELD OF THE INVENTION

This invention relates to a running toy which is movable straight in a direction other than orientation of its body.

BACKGROUND OF THE INVENTION

Heretofore, there has been known a running toy, such as a toy car, which is movable by means of a driving device utilizing a resilient force of a spiral spring However, such a type of the running toy is only movable straight forwardly in a single direction unless a directionconverting device is used, and cannot change orientation of a chassis in relation to that of a body (for example, Japanese Opened Patent Application No. 57-206471).

SUMMARY OF THE INVENTION

Accordingly an object of the invention is to provide a novel and interesting running toy comprising a body and a chassis mounted turnably thereto, which is movable in a direciton other than orientation of the body by changing orientation of the chassis in relation to that of the body.

The above object may be achieved in accordance with the invention by a running toy which comprises a body and a chassis mounted thereto, said chassis containing a driving measns and being turnable in a horizontal plane in relation to the body.

Preferably, a driving means for the running toy comprises a spiral spring and a reduction gear mechanism.

The invention will be described herein below in more detail with reference to the accompanying drawings.

PREFERRED EMBODIMENTS OF THE INVENTION

Figure 1:
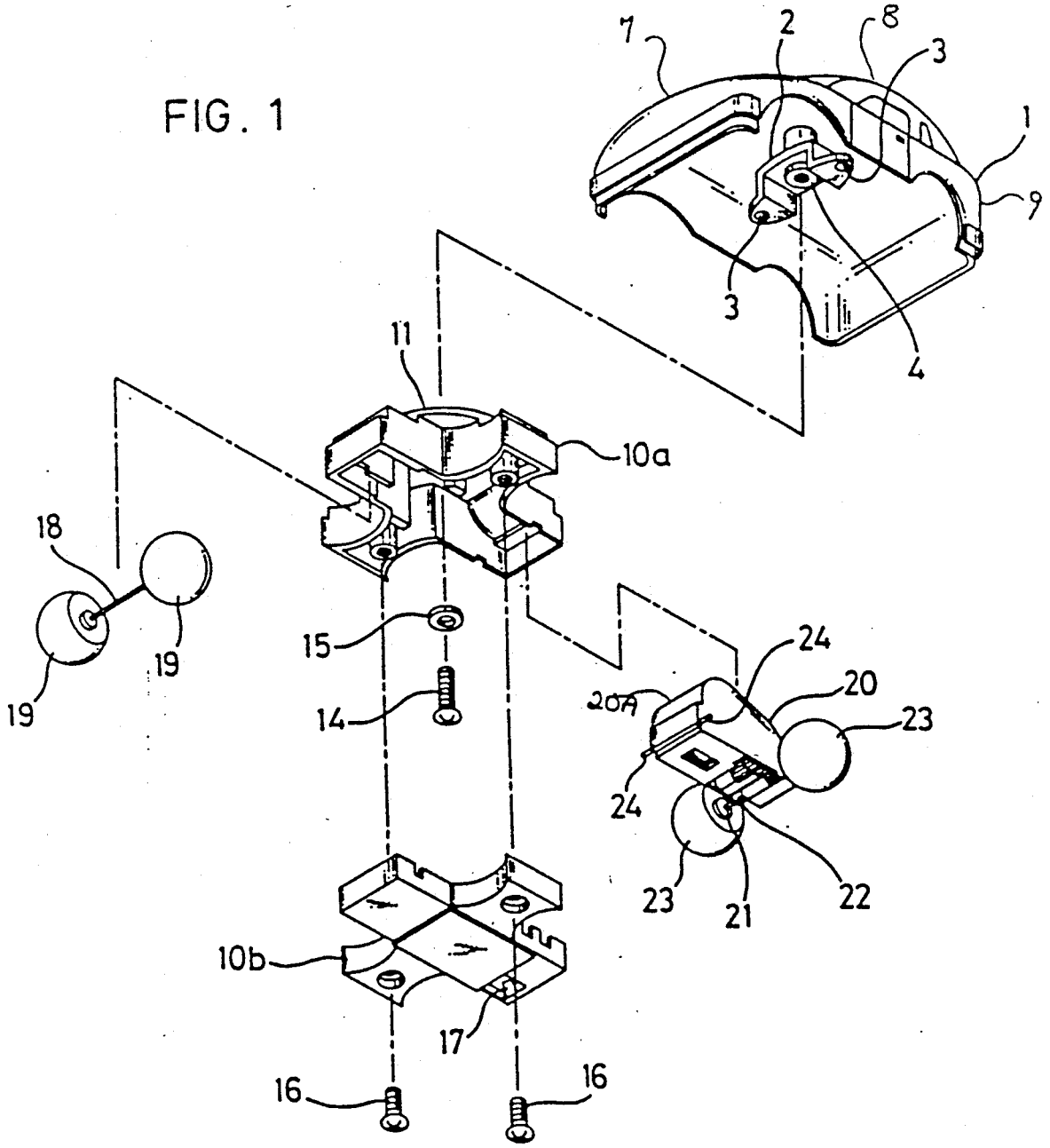
FIG. 1 is a broken perspective view of a running toy according to the invention.
Figure 2:
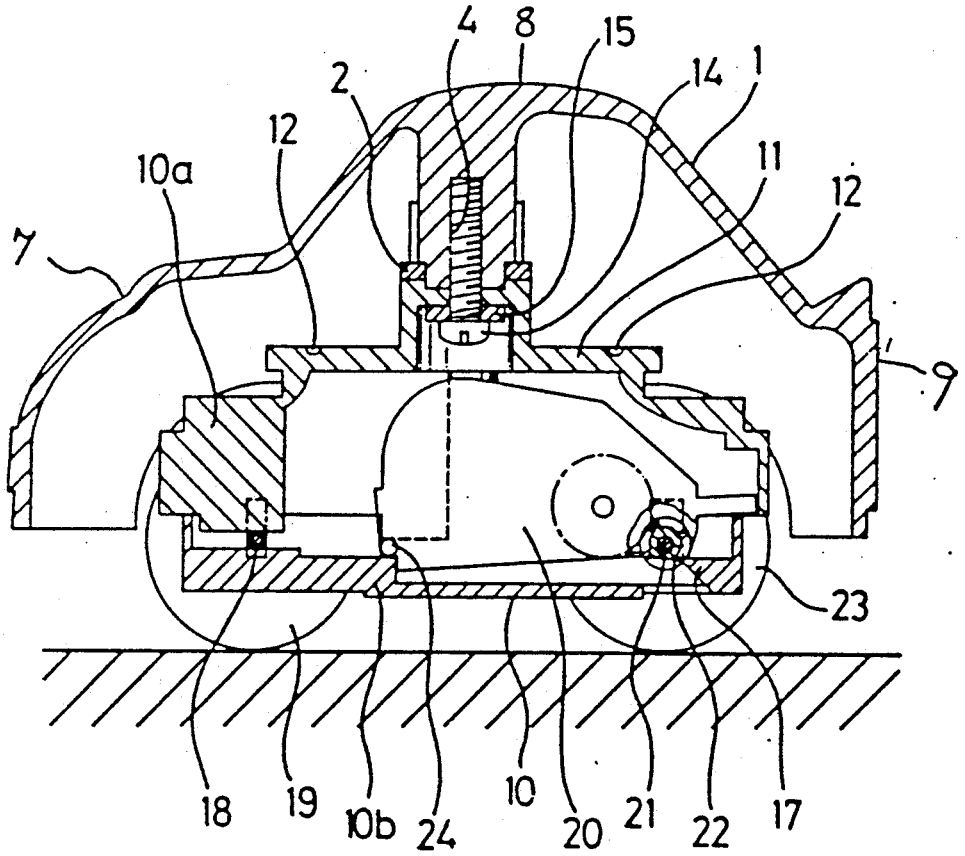
FIGS. 2 and 3 are longitudinally sectional side views.
Figure 3:
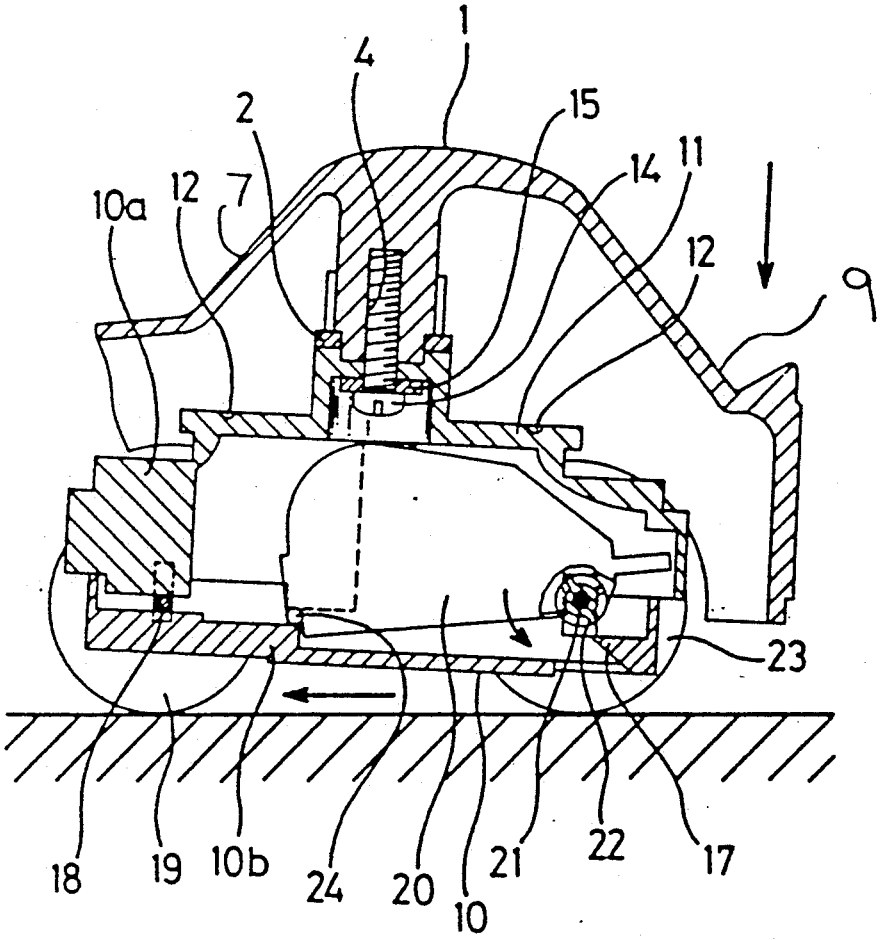
Figure 4:
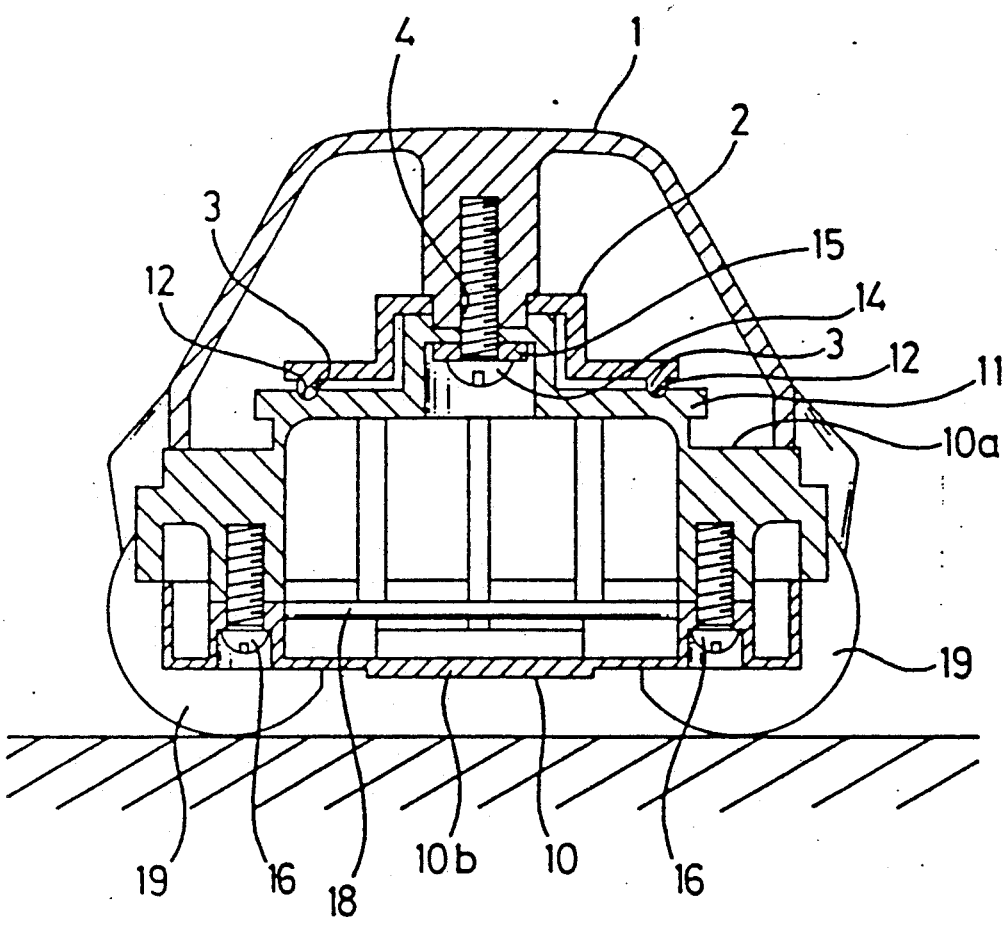
FIG. 4 is a longitudinally sectional front view.
Figure 5:
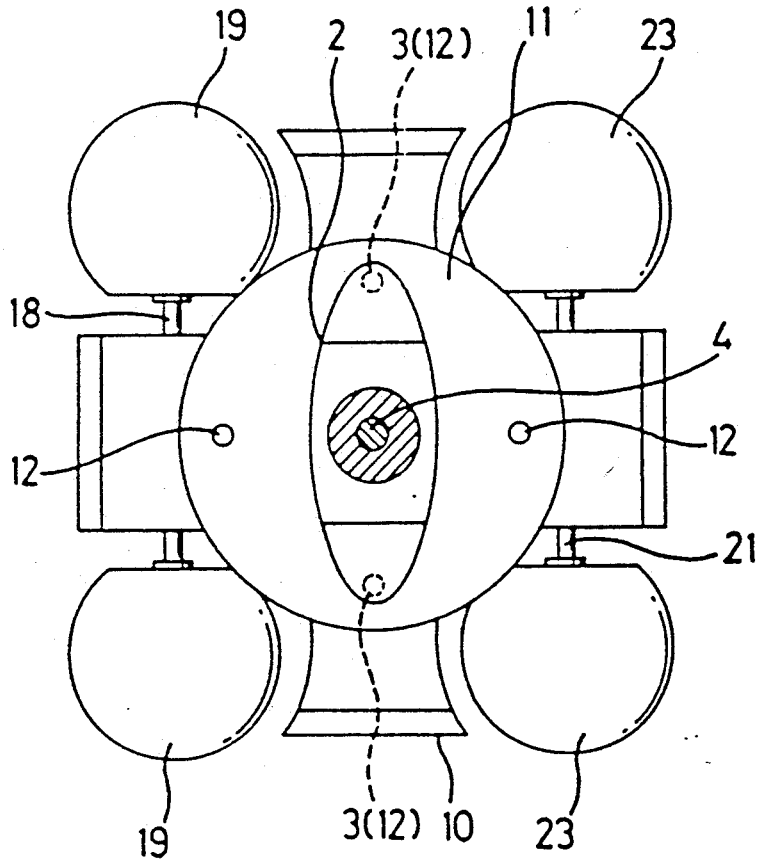
FIG. 5 is an elevated perspective of the chassis.

A running toy A according to the invention comprises a body and a chassis 10.

The chassis 10 contains therein a driving means 20 having a driving shaft 21 rotatable through release of a resilient force stored in a spring.

The body 1 is mounted to an upper part of the chassis 10 turnably in a horizontal plane. When orientation of the chassis 10 is set in a given direction relative to the body 1, the chassis 10 is removably engaged with body 1 through an engaging means, thereby to prevent the chassis 10 from readily turning in relation to the body 1 by an accidentally external force.

The body 1 at a center of its underface is fixed with an engaging piece 2 of a cross-sectional hat shape. The engaging piece 2 at its either flexible end is provided downwardly with engageable protrusion 3. In the drawings, reference 4 represents an internal thread for securing a mounting thread 14 in order to mounting the chassis 10 turnably. The internal thread 4 is arragned at a center of the engaging piece.

The chassis 10 comprises an upper chassis frame 10*a* and a lower chassis frame 10*b*, with an upper part of the upper frame 10*a* being provided with an engaging disc 11 which at its upper surface is provided with a pluraity of engageable recesses 12 (in this embodiment four recesses spaced apart at 90 degrees), each of which is removably engageable with the protrusion 30 of the engaging piece 2. The engaging means consisting of the recesses 12 and the protrusions 3 ensures the engagement of the body 1 with the chassis 10. Position and number of the recesses to be arranged may be suitably determined.

Further, the chassis 10 is shaped in a cruciform, which at its four corners are provided with a pair of driving wheels 23, 23 fixed to either end of a driving shaft 21 of a driving means 20 mounted at a rear portion of the body 1,and with a pair of running wheels 19, 19 fixed to either end of an axle 18 rotatably supported at a front portion of the body 1, respectively. Distances between the driving wheels 23 and 23, between the running wheels 19 and 19, as well as between the driving wheel 23 and the running wheel 19 are determined equal, respectivly.

The driving means 20 is provided at its either side with a protruded shaft pin 24 in a front, and is received in the chassis 10 so as to permit slight vertifcal swinging movement on the shaft pin 24. Further, the driving shaft 21 fixed with a protrusion 22 engageable with a clip 17 on a lower chassis frame 10*b*. When the clip 17 is engaged with the protrusion 22, a spring of the driving means 20 is surely protected from releasing its accumulated resilient force.

In the drawings, reference 15 represents a washer which is mouned between a screw 14 and an upper chassis frame 10*a* for allowing smooth turning movement of the chassis 10 against the body 1. Reference 16 represents a screw for connecting the upper chassis frame 10*a* to the lower chassis frame 10*b*.

The running wheels 19 and the driving wheels 23 are in thr form of a spherical crown, which improves an appearance of the toy A regardless of relative turned position between the body 1 and the chassis 10, and permits convenient observation of any running direction of the toy A.

Although the driving means 20 has been illustrated with the spring having the resilient driving force, any other means (such as a motor or a flywheel) may be utilized.

The running toy A according to the invention thus constructed will be described for its operation herein below. At first, the body 1 is pushed downward for urging the driving wheels 23 against a floor and moved backward for storing the resilient force in the spring. When the downward pushing force on the body 1 is removed, the protruded piece of the protrusion 22 is engaged with the clip of the chassis 10 to prevent the accumulated resilient force of the spring from being released, thereby to prevent foward rotation of the driving shaft 21. Thereafter, the chassis 10 is turned relative to the body 1 by a desired angle (the engaging protrusion 3 may engage with one of the recesses 12 for ensuring the desired turning position), and then the toy A is placed on the floor. Finally, the body 1 is slightly pushed downward for disengaging the clip 17 from the protrusion 22, thereby to release the accumulated resilient force of the spring in the driving means 20 for allowing the toy A to move in any established direction.

Thus in accordance with the invention, the chassis 10 containing the driving means 20 may be readily turnable in relation to the body 1 in a horizontal plane, so that the toy A may move with its body 1 being oriented in any other direction different from that of the chassis 10 (for example, rearwardly, laterally or diagonally). Accordingly, the running toy of the invention may be amusingly operated by a child and is simple in its construction, resulting in a robust and durable toy.

What is claimed is:

1. A running toy comprised of a chassis containing a driving means, said driving means capable of driving said chassis in a first direction, and a body with a distinct front and a distinct rear section, said body being mounted upon said chassis with an engaging means so that the body may be pivoted in a horizontal plane in relation to the chassis and secured in a position upon said chassis with said front section of said body oriented in a direction different from said first direction wherein said body is shaped like a car.

2. A running toy according to claim 1, wherein the engaging means comprises:

an engaging piece having projections thereon and an engaging disc having a plurality of recesses configured to cooperatively engage removably with said porjections.

3. A running toy according to claim 2, wherein the engaging piece is disposed on either the chassis or body and the engaging disc is disposed on the other of the chassis or body.

* * * * *